US006456255B1

(12) United States Patent
Lundahl

(10) Patent No.: US 6,456,255 B1
(45) Date of Patent: Sep. 24, 2002

(54) METHOD TO CAMOUFLAGE AN ANTENNA

(75) Inventor: Nestori Lundahl, Espoo (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 09/790,170

(22) Filed: Feb. 21, 2001

(51) Int. Cl.[7] ..... H01Q 1/42; H01Q 1/40
(52) U.S. Cl. ..... 343/872; 343/873
(58) Field of Search ..... 343/872, 878, 343/873, 874, 894, 770, 700 MS; 52/40; H01Q 1/42, 1/40

(56) References Cited

U.S. PATENT DOCUMENTS

| | | | | | |
|---|---|---|---|---|---|
| 4,914,448 | A | * | 4/1990 | Otsuka et al. | 343/700 MS |
| 5,142,293 | A | | 8/1992 | Ross | 343/840 |
| 5,349,362 | A | | 9/1994 | Forbes et al. | 343/720 |
| 5,428,830 | A | | 6/1995 | Zerod et al. | 455/291 |
| 5,625,369 | A | * | 4/1997 | Newman | 343/770 |
| 5,729,241 | A | | 3/1998 | Ergen et al. | 343/872 |
| 5,787,649 | A | | 8/1998 | Popowych et al. | 52/40 |
| 5,918,183 | A | | 6/1999 | Janky et al. | 455/550 |
| 5,963,178 | A | | 10/1999 | Jones | 343/890 |
| 6,025,803 | A | | 2/2000 | Bergen et al. | 343/700 MS |
| 6,122,866 | A | | 9/2000 | Thomas et al. | 52/40 |

FOREIGN PATENT DOCUMENTS

| | | | | | |
|---|---|---|---|---|---|
| GB | 2234117 | A | * | 1/1991 | H01Q/1/42 |
| GB | 2246242 | A | * | 1/1992 | H01Q/1/42 |

* cited by examiner

*Primary Examiner*—Don Wong
*Assistant Examiner*—Trinh Vo Dinh
(74) *Attorney, Agent, or Firm*—Cohen, Pontani, Lieberman & Pavane

(57) ABSTRACT

A method is provided for camouflaging an antenna, and especially a microcell antenna, by taking a photograph of an area the surface to which the antenna is to be mounted, transferring the photographed image to an image transfer paper, and mounting the image transfer paper in front of the mounted antenna to camouflage the antenna. The antenna will therefore be substantially invisible to the public and eliminate or at least minimize any public outcry over the mounting of the antennas.

8 Claims, 5 Drawing Sheets

METHOD TO CAMOUFLAGE AN ANTENNA

BACKGROUND OF THE INVENTION

1. Field of the Invention

This invention relates to a system and method of camouflaging an antenna mounted outdoors.

2. Description of the Related Art

Wireless communication (cellular) networks require that a multitude of base stations be installed throughout a particular geographical area where the network is to provide coverage. Heavy wireless network usage necessitates the installation of ever more closely spaced base stations. To reduce excessive interference caused by overlapping coverage areas of the more closely spaced base stations and the attendant complications in handing over the numerous calls between such closely spaced base stations, microcellular technology is being adapted for use in urban areas. In microcellular technology, a base station communicates with a mobile phone via a low power microcell antenna that is provided for each cell in the wireless network and is mounted to the outside of a building below the top of the building rather than on a rooftop. The network of microcell antennas are spaced relatively closely to one another and avoid interference that would otherwise be caused by overlapping coverage areas for antennas in adjacent cells by using the buildings to which the antennas are mounted to block the interference. Thus, microcell antennas are often installed only one or two stories above street level and are therefore far more visible than antennas installed elsewhere, such as on rooftops, telephone poles, church steeples, etc.

As a result, the microcell antennas may disturb the public. Aesthetically and architecturally, the antennas, which are often painted gray, stand out against an exterior wall or other surface, particularly where the wall is made of brick, limestone, etc., due to the color clash and the mismatch between the industrial design of the antennas and the architecture of the building facade. Also, many people fear that antennas cause radiation and cancer and are concerned about microcell antennas even though microcell antennas transmit at relatively low power. People tend to be much more nervous about very visible antennas and believe that antennas installed closer to the street level cause greater radiation even though the radiation emitted by the microcell antennas mounted at a second story level is even lower at street level than the radiation emitted by a mobile phone antenna. For this reason, some members of the public may avoid walking below the antennas and/or avoid entering commercial establishments, like shops and bars, located below the antennas. It is therefore desirable to camouflage the antennas. Although the antennas can be custom painted to approximate the surface upon which the antennas are mounted, such painting is a laborious, skilled and expensive undertaking.

SUMMARY OF THE INVENTION

In accordance with a first embodiment of the invention, a method of camouflaging an antenna mounted to a surface is provided. The method comprises photographing an area of a surface to which an antenna is to be mounted to capture an image of the surface area before the antenna is mounted, transferring the image to an image transfer material, and mounting the image transfer material, after the antenna is mounted, to a position in front of the mounted antenna to camouflage the antenna. The antenna could be a microcell antenna or another type of antenna, whether for a wireless network or for any other purpose. As a result of such camouflaging, the public is unaware of the placement of the antenna.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
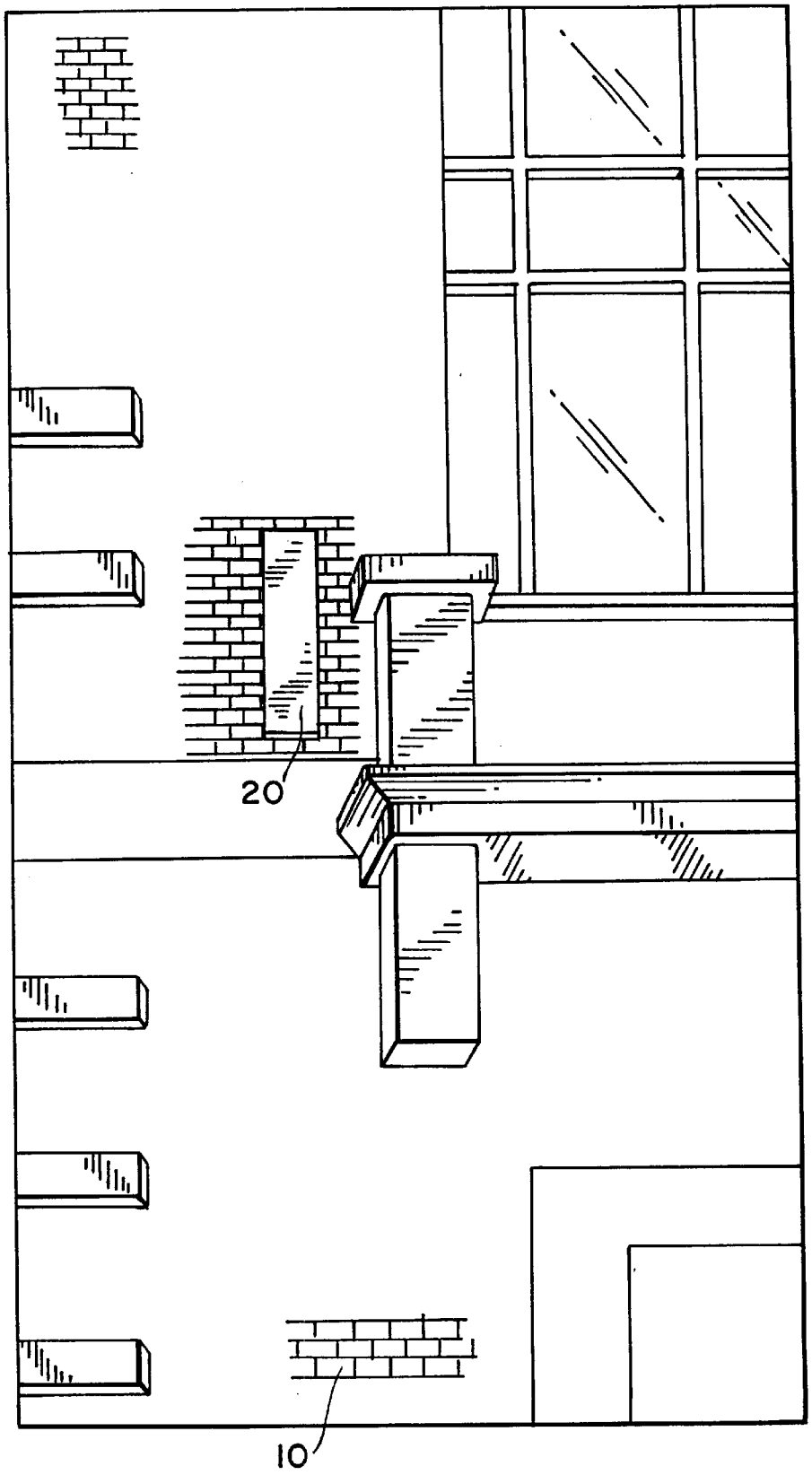
FIG. 1 is a photograph of an exterior wall of a building with the antenna installed thereon.
Figure 2:
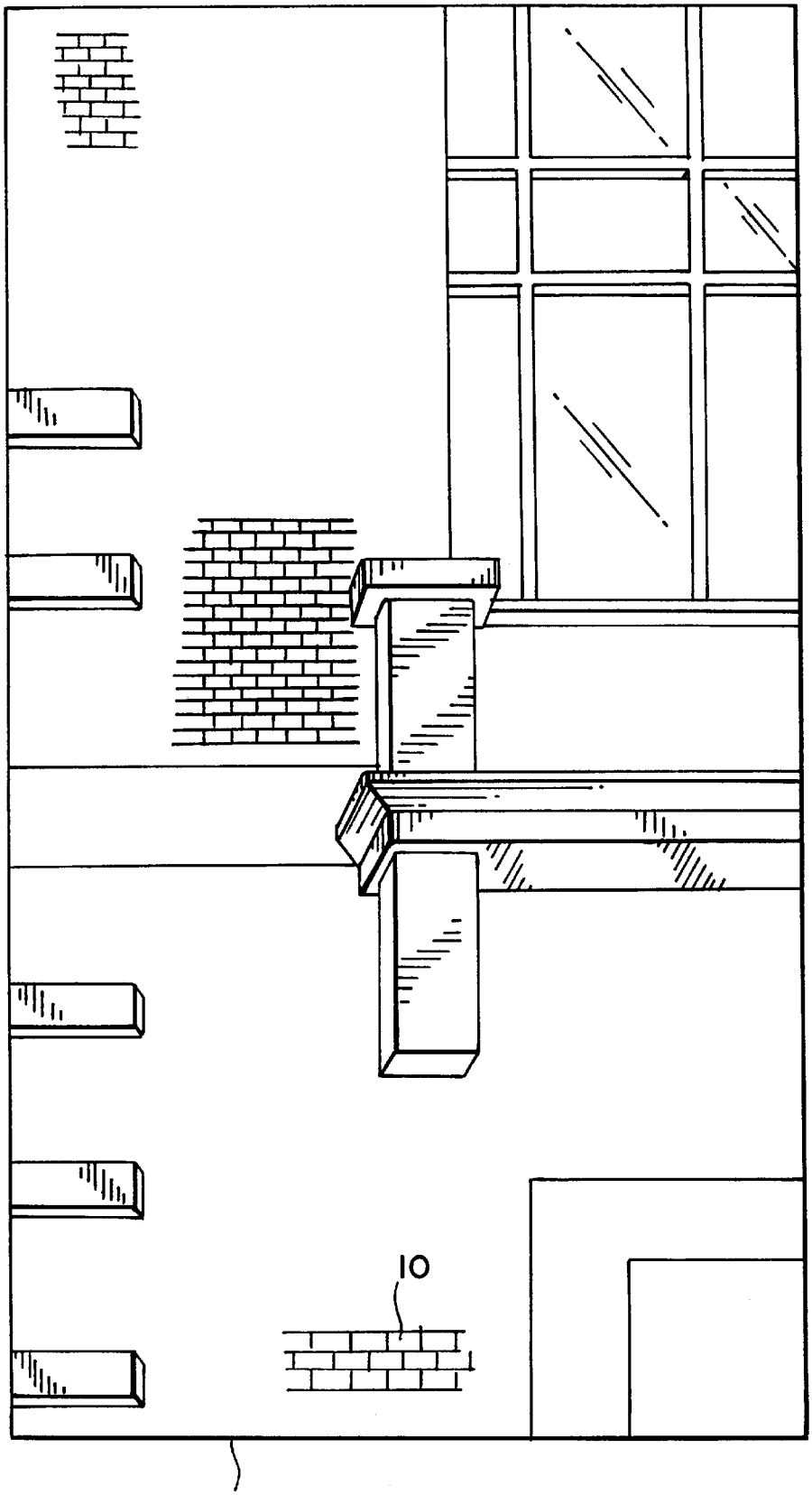
FIG. 2 is a photograph of the exterior wall of FIG. 1 before the antenna is installed.
Figure 3:
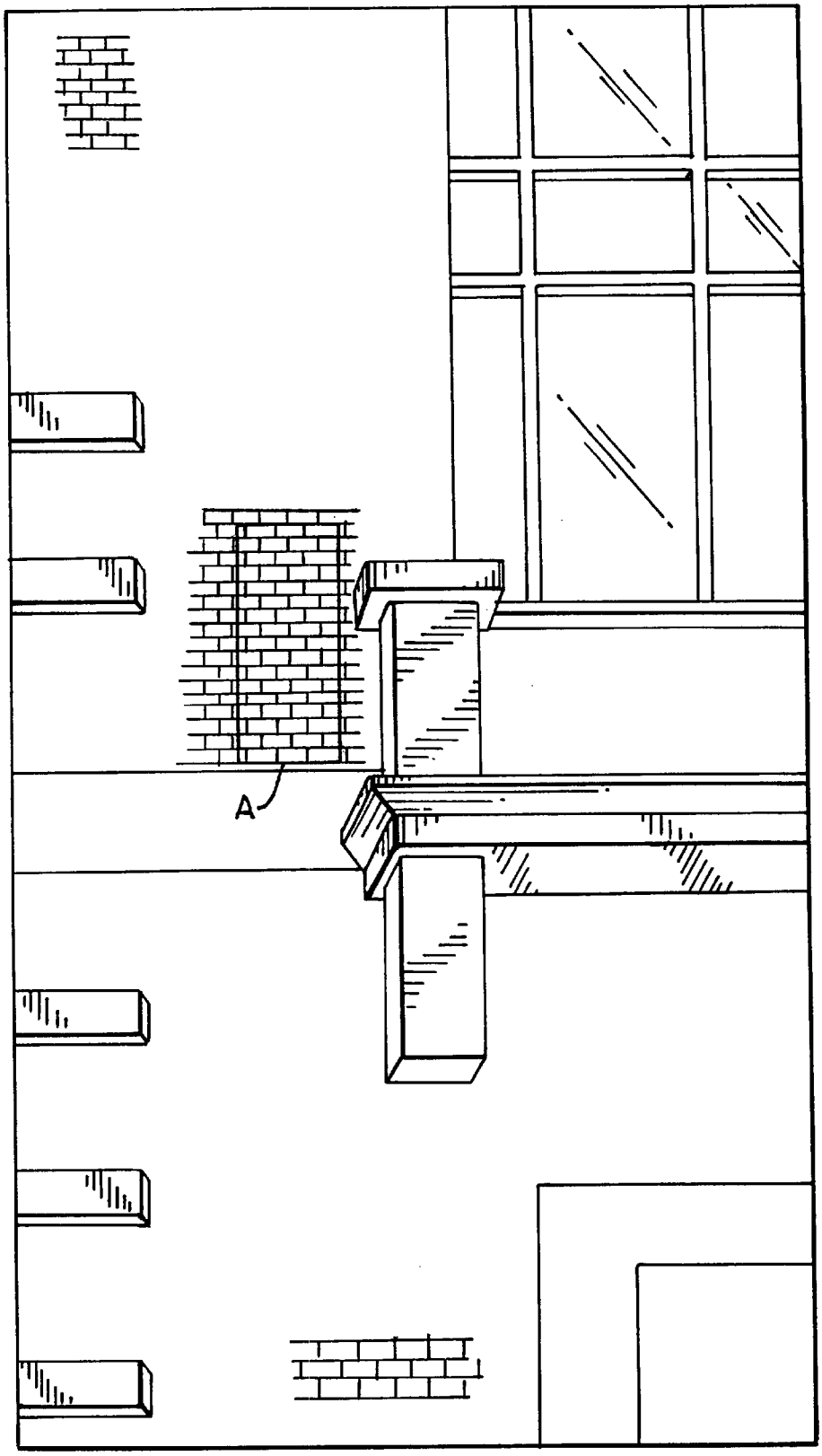
FIG. 3 is the photograph of FIG. 2 demarcating the an area of the exterior wall within which the antenna is to be installed.
Figure 4:
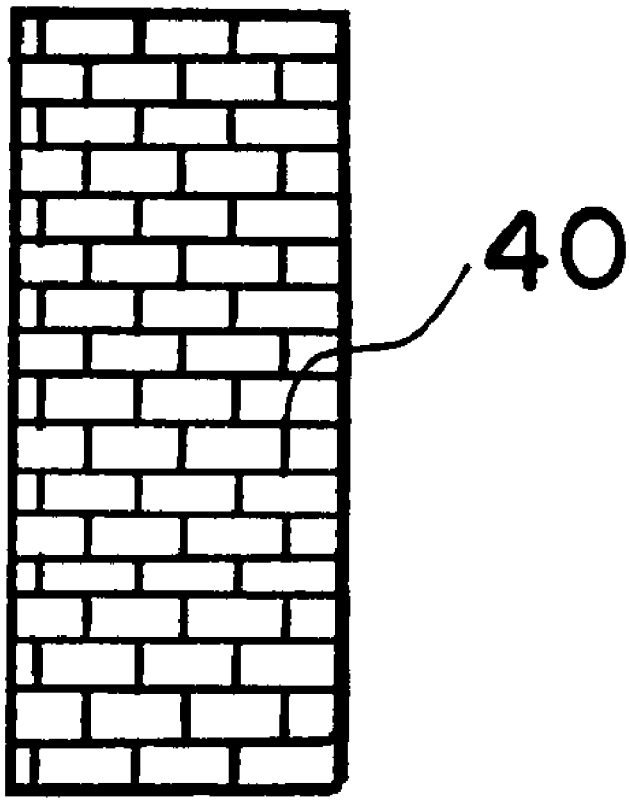
FIG. 4 depicts a plastic cover created using the photograph of FIG. 2 to camouflage the antenna.

FIG. 1 illustrates an example of an exterior wall 10 of a building to which a microcell antenna 20 for enabling communications between a mobile phone and a wireless communications network is mounted. In this example, wall 10 essentially has a brick facade with various architectural surface details. The microcell antenna 20 is undesirably conspicuous. To camouflage antenna 20 in accordance with the present invention, before antenna 20 is installed, a photograph 30 from ground or street level, shown in FIG. 2, is taken of the exterior section of the building facade where the antenna is to be mounted. Photograph 30 may include a picture of surrounding areas of the exterior wall 10 that will not be covered by antenna 20 and therefore need not be camouflaged. Where the photograph 30 is digital, it can be processed by a user on a computer to demarcate area A, as shown in FIG. 3, which is the area that is defined as the area to which antenna 20 will be mounted. Where the photograph 30 is not digitally captured, the photograph 30 can be cropped to capture only the desired part of the photograph. Area A of the photograph 30 is enlarged and transferred to an image transfer paper on which the desired part of the photograph is printed as an image having dimensions that are approximately the actual size of area A on wall 10 that is to be camouflaged. The resulting printed image transfer paper is essentially a large poster (or decal) 40, as shown in FIG. 4, depicting the surface area of wall 10 where antenna 20 is to be mounted. Poster 40 should be printed on a medium that can be mounted outdoors and withstand the elements, like the rain, moisture, etc.

One suitable method of creating poster 40 from photograph 30 is by using the well-known Scotchprint® Graphics system offered by the 3M Company of St. Paul, Minn. In the Scotchprint® Graphics system, the captured digital image is transferred to an image transfer paper, or other image transfer material, of a specified size and at a given resolution, and the image transfer paper is laminated. It is generally best to use a high resolution image for the best camouflaging effect. A backing paper on the back of a Scotchprint® paper is removable to uncover an adhesive backing that is used to affix the Scotchprint® paper to the desired surface. Other plastic poster materials and methods of creating them are also well known and suitable, although poster 40 need not comprise a plastic material.

Figure 5:
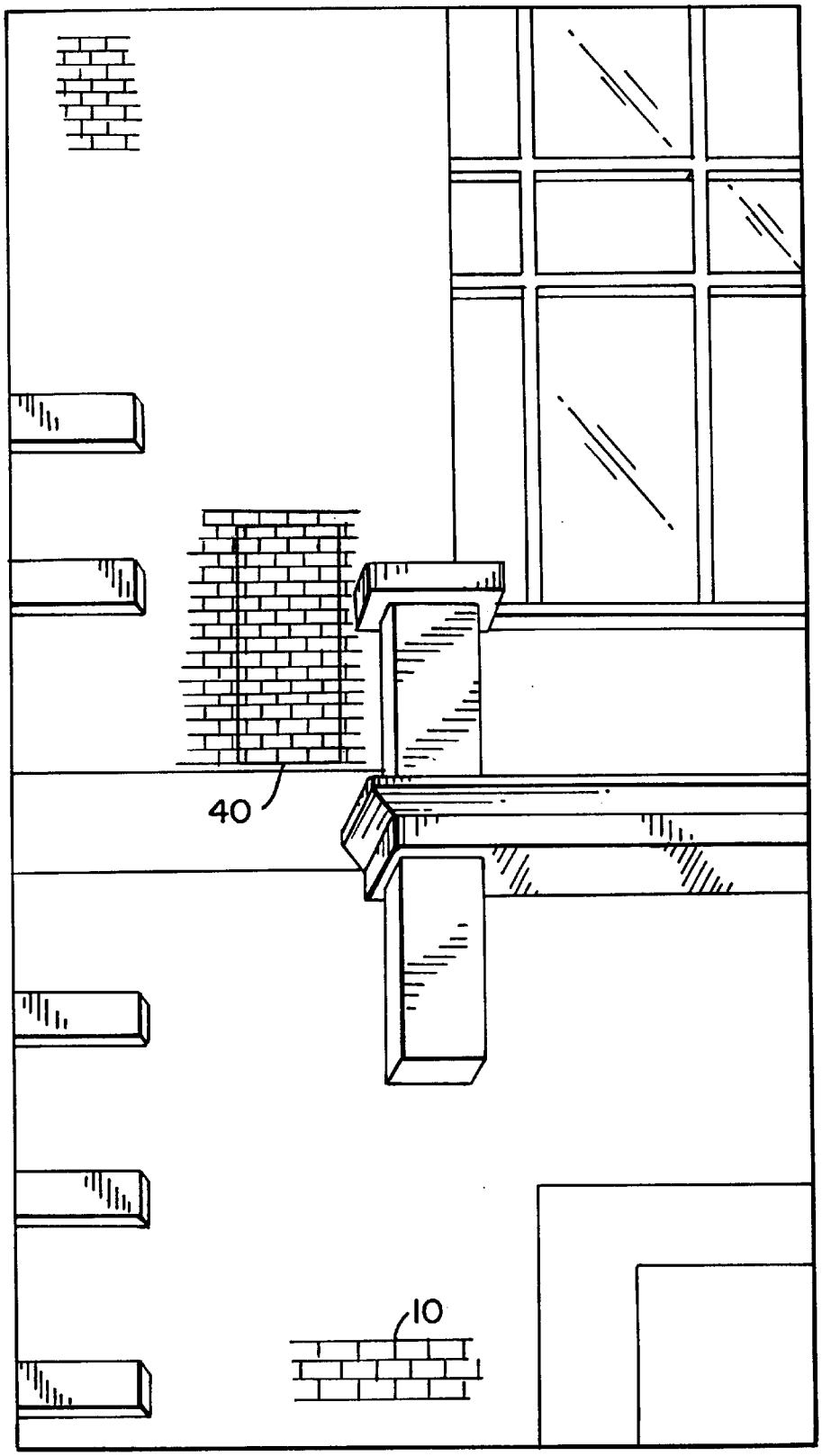
FIG. 5 depicts the exterior wall after the antenna is installed and the plastic cover is installed.

Poster 40 is thereafter placed in front of or attached to antenna 20, as shown in FIG. 5, to camouflage antenna 20. Poster 40 can be put into place in any of various ways such as by affixing poster 40 with adhesive or by some other means directly to antenna 20, as where poster 40 is printed on Scotchprint® material having an adhesive backing. As an alternative, poster 40 can be attached to a wooden board or other flat or contoured surface that is mounted to wall 10 or to antenna 20 with brackets (not shown) or other means so as to cover the antenna 20 from street level view, and poster 40 is attached thereto. Poster 40 should, of course, be mounted in such a way that any surface details, such as the brick pattern of wall 10 or any other surface ornamentation that remain exposed in a surrounding area of wall 10 that is adjacent poster 40, substantially align with architectural surface details on poster 40, such as the brick pattern on poster 40, in order to blend together. A transparent cover can also be installed in front of or mounted to poster 40, if necessary, to protect poster 40, but it is preferable that poster 40 be made of a sturdy material that does not require a transparent cover so the camouflage is as unnoticeable as possible. When properly camouflaged, poster 40 will cover antenna 20 so that antenna 20 will be substantially invisible to the public.

It should be understood that the inventive system is not limited to camouflaging an antenna mounted to a wall but could also be used to camouflage an antenna mounted to any surface.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice.

What is claimed is:

1. A method of camouflaging an antenna mounted to a surface, the method comprising following steps of:

photographing an area of the surface to which the antenna is to be mounted to capture an image of the surface area before the antenna is mounted;

printing the image onto an image transfer material; and mounting the image transfer material, after the antenna is mounted, to a position in front of the mounted antenna to camouflage the antenna.

2. The method of claim 1, wherein the photographing step comprises photographing the surface area with a digital camera to capture the image of the surface area as a digital image, and wherein the printing step comprises printing the captured digital image with a printer on the image transfer material.

3. The method of claim 1, wherein the step of mounting the image transfer material comprises mounting the image transfer material directly to the antenna.

4. The method of claim 3, wherein the captured image depicts details of the surface, and wherein the step of mounting the image transfer material directly to the antenna comprises mounting the image transfer material to the surface with the surface details of the captured image in alignment with surface details on the surface adjacent that is not camouflaged by the image transfer material.

5. The method of claim 1, wherein the surface is an exterior wall of a building, and the surface area of which the image is captured comprises an area of the exterior wall to which the antenna is mounted.

6. The method of claim 1, wherein the antenna is a microcell antenna of a wireless communications system.

7. The method of claim 1, wherein the image transfer material comprises a sheet of material that is laminated.

8. An image transfer sheet suitable for mounting onto an antenna to camouflage the antenna, the image transfer sheet comprising image transfer material having an image printed thereon, the image being a photograph of an area of a surface to which the antenna is to be mounted.

* * * * *